US008833382B2

(12) United States Patent
Gradischer et al.

(10) Patent No.: US 8,833,382 B2
(45) Date of Patent: Sep. 16, 2014

(54) ARTICLE HAVING GOOD WEAR RESISTANCE

(75) Inventors: Glenn Gradischer, Canton, CT (US); Kevin M. Rankin, Windsor, CT (US); Blair A. Smith, South Windsor, CT (US); Angelina Y. Cheung, South Windsor, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 440 days.

(21) Appl. No.: 13/237,102

(22) Filed: Sep. 20, 2011

(65) Prior Publication Data

US 2012/0119132 A1 May 17, 2012

Related U.S. Application Data

(60) Provisional application No. 61/412,659, filed on Nov. 11, 2010.

(51) Int. Cl.

| | |
|---|---|
| ***F16K 27/00*** | (2006.01) |
| ***C23C 4/08*** | (2006.01) |
| ***C23C 30/00*** | (2006.01) |
| ***C23C 8/70*** | (2006.01) |
| ***C23C 8/68*** | (2006.01) |

(52) U.S. Cl.

CPC . *C23C 30/00* (2013.01); *C23C 4/08* (2013.01); *C23C 8/70* (2013.01); *C23C 8/68* (2013.01)

USPC ..... 137/1; 137/375; 251/368

(58) Field of Classification Search

USPC ..... 137/1, 375; 251/368

See application file for complete search history.

(56) References Cited

U.S. PATENT DOCUMENTS

| | | | | | |
|---|---|---|---|---|---|
| 2,525,831 | A * | 10/1950 | Scherer | 251/368 |
| 3,241,812 | A * | 3/1966 | Worden et al. | 251/357 |
| 3,829,260 | A | 8/1974 | Shimoda | |
| 4,188,011 | A * | 2/1980 | Akkerman | 251/63.4 |
| 4,347,865 | A * | 9/1982 | Worley | 137/375 |
| 4,565,217 | A * | 1/1986 | McIntyre | 137/625.5 |
| 5,017,410 | A | 5/1991 | Hodgens, II | |
| 5,040,501 | A * | 8/1991 | Lemelson | 427/585 |
| 5,222,521 | A * | 6/1993 | Kihlberg | 251/368 |
| 5,441,235 | A * | 8/1995 | Narasimhan et al. | 251/368 |
| 5,540,252 | A | 7/1996 | Bruun | |
| 5,981,081 | A | 11/1999 | Sue | |
| 6,048,171 | A | 4/2000 | Donnelly et al. | |
| 6,186,508 | B1 | 2/2001 | Zajchowski et al. | |
| 6,718,932 | B1 * | 4/2004 | Cecur et al. | 123/188.3 |
| 6,815,099 | B1 | 11/2004 | Zajchowski et al. | |
| 7,137,612 | B2 * | 11/2006 | Baca | 251/122 |
| 7,555,905 | B2 | 7/2009 | Borcea | |
| 7,562,647 | B2 * | 7/2009 | Burton et al. | 137/375 |
| 7,951,459 | B2 | 5/2011 | Tang et al. | |
| 7,985,703 | B2 | 7/2011 | Freling | |
| 2004/0129314 | A1 * | 7/2004 | Welty et al. | 137/375 |
| 2007/0144839 | A1 | 6/2007 | Seksaria | |
| 2007/0163655 | A1 * | 7/2007 | Hunter | 137/375 |
| 2008/0145649 | A1 | 6/2008 | Mannem | |
| 2010/0258073 | A1 | 10/2010 | Endicott et al. | |

OTHER PUBLICATIONS

EP Search Report dated Jan. 17, 2012.

* cited by examiner

*Primary Examiner* — John Bastianelli

(74) *Attorney, Agent, or Firm* — Carlson, Gaskey & Olds, P.C.

(57) ABSTRACT

An article having good wear resistance includes a first component including a boride coating and a second component including a cobalt-chromium-molybdenum coating that is in sliding contact with the boride coating of the first component.

21 Claims, 3 Drawing Sheets

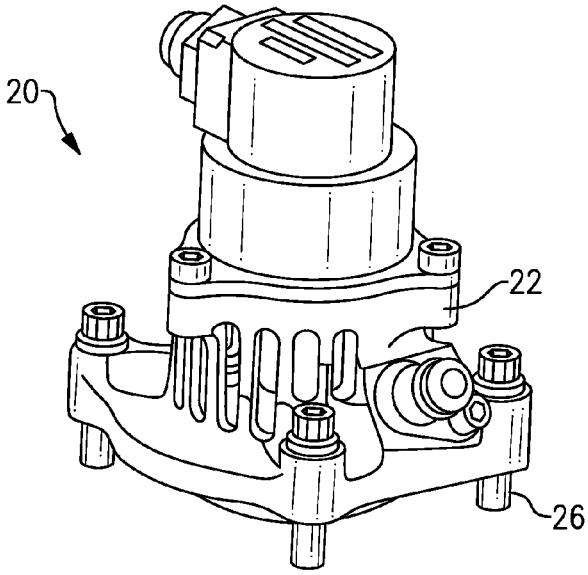
FIG.1
FIG.2A
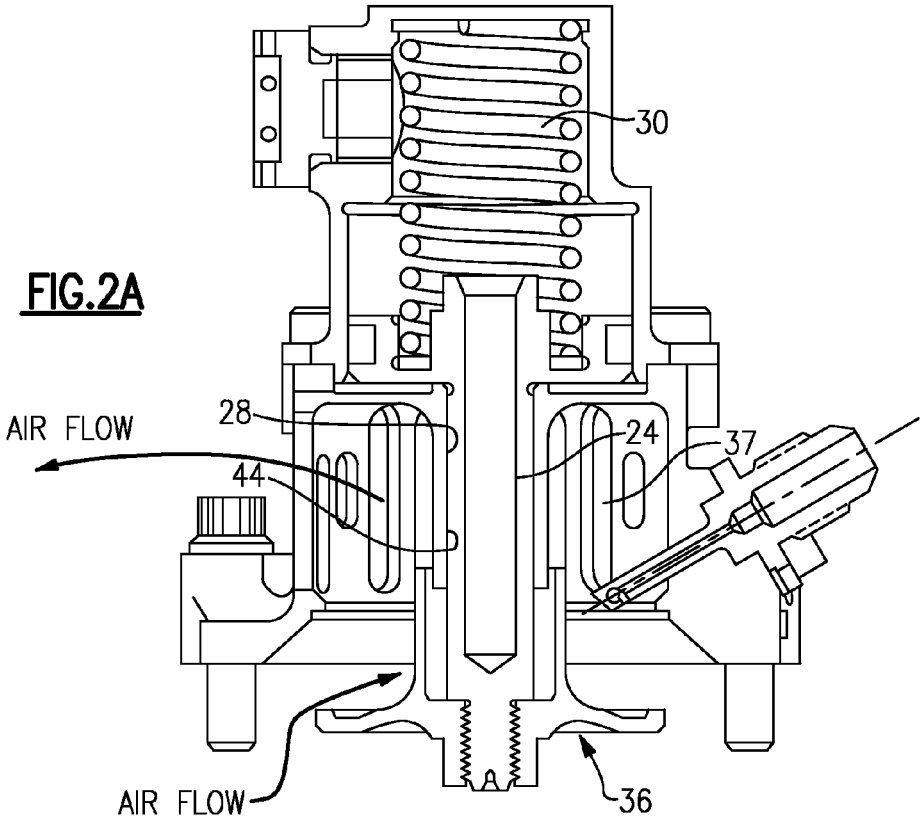

FIG.2B
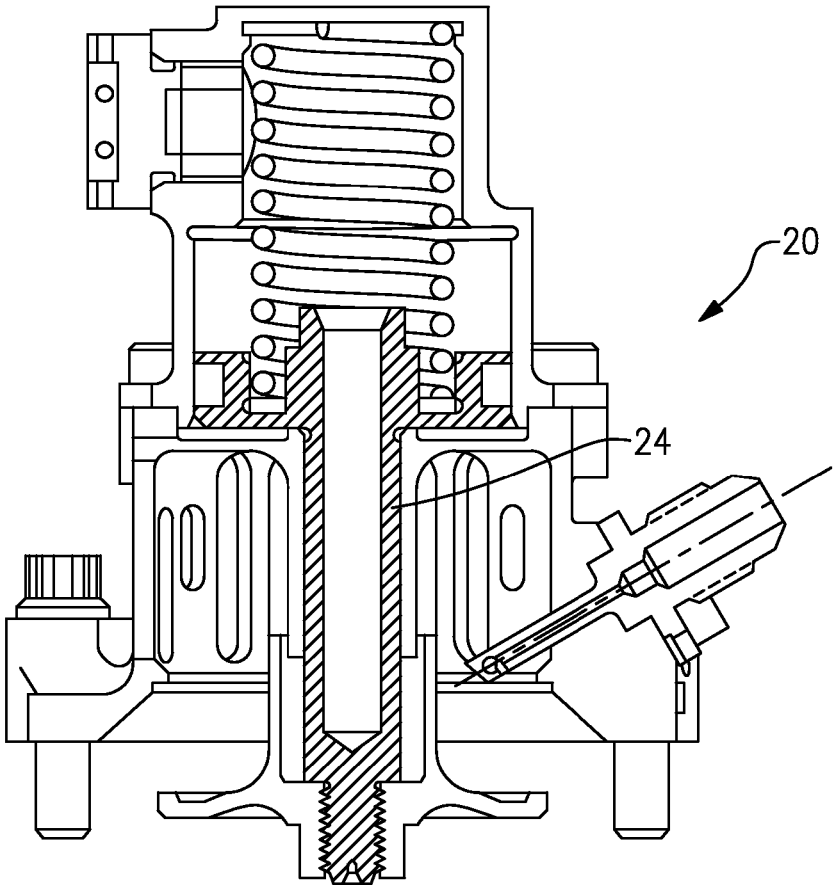
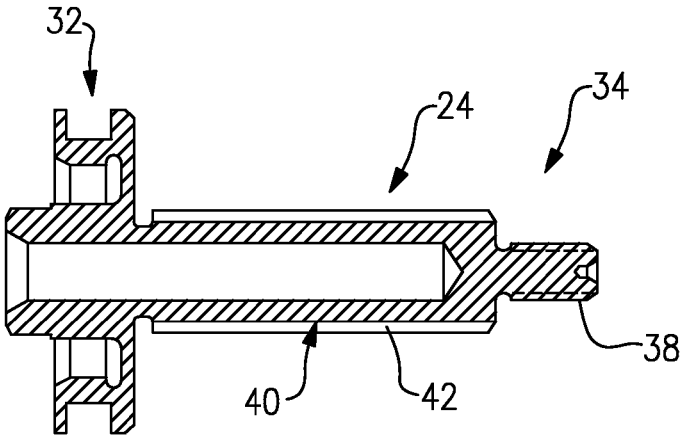
FIG.3

ARTICLE HAVING GOOD WEAR RESISTANCE

CROSS-REFERENCE TO RELATED APPLICATIONS

This disclosure claims priority to U.S. Provisional Application No. 61/412,59, which was filed on Nov. 11, 2010 and is incorporated herein by reference.

BACKGROUND

This disclosure relates to wear resistant coatings for articles used in high temperature conditions.

Components that are subject to wear during the operation may include a wear resistant coating that extends the life of the component. Conventional coatings that may be used at high temperatures, such as chromium coatings, are undesirable for environmental reasons.

SUMMARY

Disclosed is an article having good wear resistance. The article has a first component including a boride coating and a second component including a cobalt-chromium-molybdenum coating that is in sliding contact with the boride coating of the first component.

In one example, the article is a valve that includes a housing with a bore and a valve element with a shaft that is received for movement within the bore. One of the bore or the shaft includes a boride coating and the other of the bore or the shaft includes a cobalt-chromium-molybdenum coating such that the cobalt-chromium-molybdenum coating is in sliding contact with the boride coating Also disclosed is a method of resisting wear. The method includes applying a boride coating to a first component and applying a cobalt-chromium-molybdenum coating to a second component that is in sliding contact with the boride coating of the first component.

BRIEF DESCRIPTION OF THE DRAWINGS

The various features and advantages of the disclosed examples will become apparent to those skilled in the art from the following detailed description. The drawings that accompany the detailed description can be briefly described as follows.

FIG. 1 illustrates a perspective view of an example article having good wear resistance.

FIG. 2A is a cross-section of the article of FIG. 1.

FIG. 2B is also a cross-section of the article of FIG. 1.

FIG. 3 is an isolated view of an example piston of the article of FIG. 1.

DETAILED DESCRIPTION OF THE PREFERRED EMBODIMENT

FIG. 1 illustrates an example article 20 that has good wear resistance between moving parts. In the example, the article 20 is a bleed valve for a high pressure compressor of an aircraft engine. However, it is to be understood that the article 20 is not limited to the example bleed valve and that this disclosure may apply to many other types of articles.

In general, the bleed valve of the article 20 includes a housing 22 in which a piston 24 (FIG. 2A) moves to control air flow from a high pressure compressor section of an aircraft engine to other portions of the engine or as a pressure release. As an example, the bleed valve may be attached to a compressor housing or other suitable structure by using bolts 26.

Figure 2C:
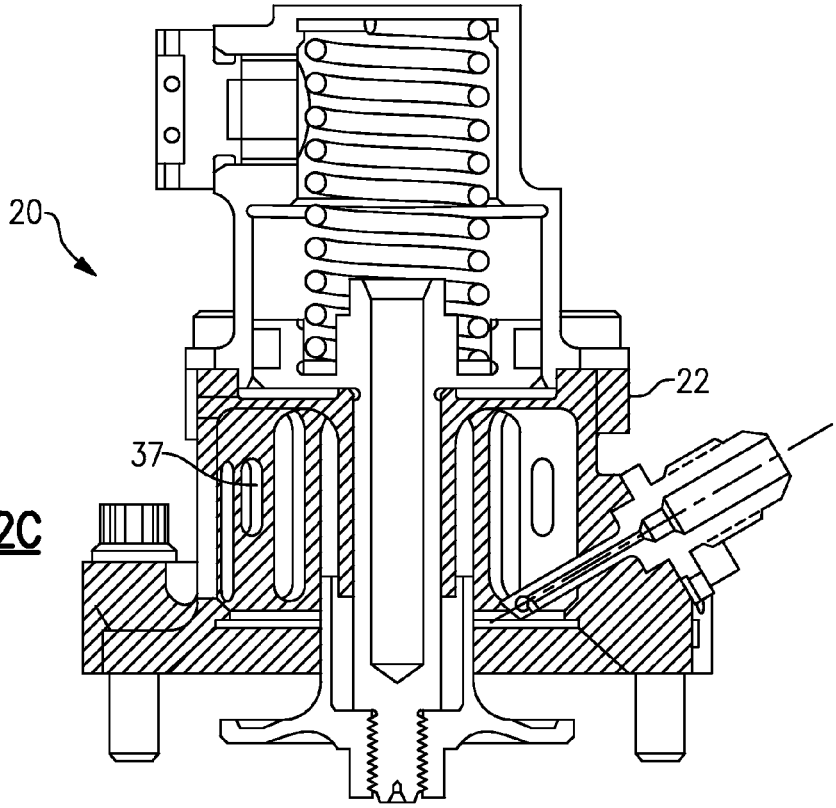
FIG. 2C is also a cross-section of the article of FIG. 1.

FIG. 2A shows a cross-sectional view of the bleed valve. FIG. 2B shows the same cross-section view but with the piston 24 shaded. FIG. 2C shows the same cross-section view, but with the housing 22 shaded. The housing defines a bore 28 in which the piston 24 moves during operation of the bleed valve. A spring 30 biases the piston 24 toward an open position.

Figure 4A:
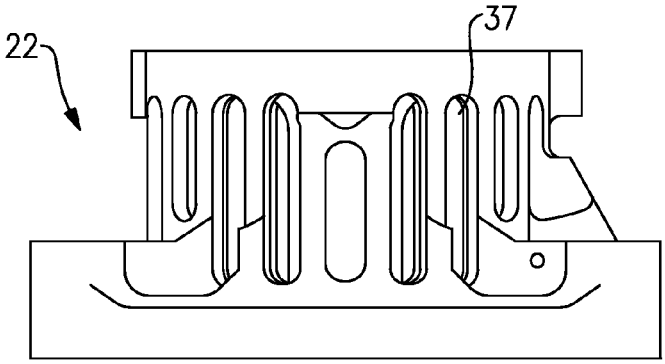
FIG. 4A is an isolated view of a housing of the article of FIG. 1.
Figure 4B:
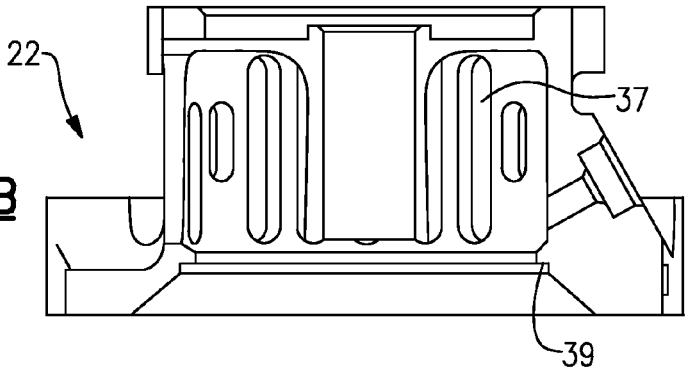
FIG. 4B is another view of the housing of FIG. 4A.

As illustrated in an isolated view of the piston in 24 FIG. 3, the piston 24 generally includes a first end 32 and a second end 34. The first end 32 engages the spring 30, and the second end 34 is adapted to engage a poppet 36 (FIGS. 2A-2C). The second end 34 of the piston 24 includes a portion 38 having threads for rigidly securing the piston 24 to the poppet 36. The poppet 36 is shown in an open position wherein air flow from the compressor travels around the poppet 36 and piston 24 into the housing 22. The air flow exits the housing through vertically oriented slots 37. The spring 30 normally biases the poppet 36 to the open position. However, when the air pressure exceeds the spring bias, the poppet 36 closes such that the piston 24 travels vertically upwards in the figures. In the closed position, the poppet 36 seals against seat 39 (FIG. 4B) to reduce or stop the air flow through the bleed valve.

A main shaft portion 40 of the piston 24 extends between the first and second ends 32 and 34. The main shaft portion 40 defines an outer peripheral surface having an outer diameter. The portion 38 also defines an outer diameter, which is less than the outer diameter of the main shaft portion 40.

The main shaft portion 40 of the piston 24 includes a wear resistant coating 42 for resisting wear from sliding movement within the bore 28 of the housing 22. As an example, the wear resistant coating 42 is a cobalt-chromium-molybdenum coating. The cobalt-chromium-molybdenum coating may have a nominal composition of 60-64 wt. % cobalt, 26-30 wt. % molybdenum, 6-10 wt. % chromium, 1-3 wt. % silicon, a maximum of 0.25 wt. % iron, and incidental impurities. The wear resistant coating 42 may be applied onto the base alloy of the piston 24 using a thermal spray process, such as high velocity oxy fuel spraying. However, the deposition of the wear resistant coating 42 is not limited and may be applied in or using other known techniques.

In embodiments, the piston 24 is formed from a base alloy, such as a superalloy material. For instance, the superalloy material may have a nominal composition of 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace amounts of other elements and incidental impurities. In a further example, the base alloy of the piston 24 is Inconel 718.

The bore 28 of the housing 22 also includes a wear resistant coating 44 that is in sliding contact with the wear resistant coating 42 of the piston 24. For instance, the wear resistant coating 44 of the bore 28 is a boride coating that is on the base alloy of the housing 22. Similar to the piston 24, the base alloy of the housing 22 may be a superalloy material, such as Inconel 718, that is capable of forming a compact and continuous boride layer in the surface. As can be appreciated, the boride coating can alternatively be on the piston 24 and the cobalt-chromium-molybdenum coating can alternatively be on the bore 28.

In embodiments, the wear resistant coating 44 of the bore 28 is a boride coating. A user may form the boride coating in a boronizing process. Generally, the boronizing process involves infusing boron into the surface of the base alloy to thereby form the hard, wear resistant coating 44. The wear resistant coating 44 may thereby be comprised of boride compounds that are formed between the boron and the constituent elements of the base alloy. The boron may also or alternatively be in solution with the base alloy.

The combination of the boride wear resistant coating 44 of the housing 22 and the cobalt-chromium-molybdenum wear resistant alloy 42 of the piston 24 provides good wear resistance in the article 20. That is, the combination of the superalloy material base alloys, the boride wear resistant coating 44 and the cobalt-chromium-molybdenum wear resistant coating 42 provide good wear resistance at a maximum operating temperature of up to 1300° F.

Additionally, each of the wear resistant coatings 42 and 44 may have a predetermined surface roughness that further facilitates wear resistance. For instance, the surface roughness of the wear resistant coating 42 and 44 may be approximately 8 microinches roughness ($R_A$) or less. In the processes of forming the wear resistant coating 42 and 44, the piston 24 and the housing 22 may be machined after formation of the wear resistant coating 42 and 44 to provide the desired surface roughness. In the case of the boride coating, which is nominally harder than the wear resistant coating 42 of the piston 24, additional secondary machining operations may be desired to achieve the selected surface roughness. Moreover, because of the relatively high hardness of the boride coating, the surface of the bore 28 of the housing 22 may be prepared prior to formation of the boride coating to reduce or eliminate the need for post-coating machining operations. For instance, the surface roughness of the bore 28 may be 8 microinches ($R_A$) prior to formation of the boride coating. Additionally, other characteristics of the surface of the bore 28 may be controlled to achieve the desired surface roughness of the boride coating.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of resisting wear, the method comprising:
applying a boride coating to a first component; and
applying a cobalt-chromium-molybdenum coating to a second component that is in sliding contact with the boride coating of the first component, wherein the cobalt-chromium-molybdenum coating comprises 60-64 wt. % cobalt, 26-30 wt. % molybdenum, 6-10 wt. % chromium, 1-3 wt. % silicon and a maximum of 0.25 wt. % iron.

2. The method as recited in claim 1, including infusing boron into a base alloy of the first component.

3. The method as recited in claim 1, including thermally spraying the cobalt-chromium-molybdenum coating onto the second component.

4. An article having good wear resistance, comprising:
a first component including a boride coating; and
a second component including a cobalt-chromium-molybdenum coating that is in sliding contact with the boride coating of the first component, wherein the cobalt-chromium-molybdenum coating comprises 60-64 wt. % cobalt, 26-30 wt. % molybdenum, 6-10 wt. % chromium, 1-3 wt. % silicon and a maximum of 0.25 wt. % iron.

5. The article as recited in claim 4, wherein the first component and the second component are parts of a valve.

6. The article as recited in claim 4, wherein the first component is one of a housing defining a bore having an inner diameter and a piston received for movement within the bore and having an outer diameter, and the second component is the other of the housing and the piston.

7. The article as recited in claim 4, wherein the first component and the second component comprise identical nickel-based superalloy compositions.

8. The article as recited in claim 4, wherein the boride coating is a continuous boride layer.

9. The article as recited in claim 4, wherein the boride coating includes compounds of boron and constituent elements of a base alloy of the first component.

10. The article as recited in claim 4, wherein at least one of the first component or the second component comprises 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace impurities.

11. The article as recited in claim 10, wherein the boride coating includes compounds of boron and constituent elements of a base alloy of the first component.

12. The article as recited in claim 10, wherein the boride coating includes boron in solution with a base alloy of the first component.

13. The article as recited in claim 10, wherein the first component and the second component are parts of a valve.

14. An article having good wear resistance, comprising:
a first component including a boride coating; and
a second component including a cobalt-chromium-molybdenum coating that is in sliding contact with the boride coating of the first component, wherein at least one of the first component or the second component comprises 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace impurities.

15. The article as recited in claim 14, wherein the first component and the second component comprise 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace impurities.

16. A valve having good wear resistance, comprising:
a housing that includes a bore;
a valve element having a shaft received for movement within the bore, one of the bore or the shaft including a boride coating and the other of the bore or the shaft including a cobalt-chromium-molybdenum coating such that the cobalt-chromium-molybdenum coating is in sliding contact with the boride coating, wherein the cobalt-chromium-molybdenum coating comprises 60-64 wt. % cobalt, 26-30 wt. % molybdenum, 6-10 wt. % chromium, 1-3 wt. % silicon and a maximum of 0.25 wt. % iron.

17. The valve as recited in claim 16, wherein the valve element includes a poppet attached to the shaft.

18. The valve as recited in claim 16, wherein the shaft includes a first portion with a first diameter and a second portion with a second, smaller diameter relative to the first diameter.

19. The valve as recited in claim 18, wherein the second portion includes a threaded end.

20. A valve having good wear resistance, comprising:

a valve element having a shaft received for movement within the bore, one of the bore or the shaft including a boride coating and the other of the bore or the shaft including a cobalt-chromium-molybdenum coating such that the cobalt-chromium-molybdenum coating is in sliding contact with the boride coating, wherein at least one of the first component or the second component comprises 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace impurities.

21. The valve as recited in claim 20, wherein the first component and the second component comprise 50-55 wt. % nickel, 17-21 wt. % chromium, 2.8-3.3 wt. % molybdenum, 4.75-5.5 wt. % niobium, approximately 1 wt. % cobalt, 0.65-1.15 wt. % aluminum, and a balance of iron and trace impurities.

* * * * *

UNITED STATES PATENT AND TRADEMARK OFFICE

CERTIFICATE OF CORRECTION

PATENT NO. : 8,833,382 B2
APPLICATION NO. : 13/237102
DATED : September 16, 2014
INVENTOR(S) : Gradischer et al.

It is certified that error appears in the above-identified patent and that said Letters Patent is hereby corrected as shown below:

IN THE CLAIMS:

In claim 20, column 5, line 16; remove “the first component” and replace with --the bore--
In claim 20, column 5, line 16; remove “the second component” and replace with --the shaft--
In claim 21, column 5, line 21; remove “the first component” and replace with --the bore--
In claim 21, column 5, line 22; remove “the second component” and replace with --the shaft--

Signed and Sealed this
Third Day of February, 2015

Michelle K. Lee

Michelle K. Lee
*Deputy Director of the United States Patent and Trademark Office*